United States Patent [19]

Wedel

[11] Patent Number: 4,486,962

[45] Date of Patent: Dec. 11, 1984

[54] MAGNETIC SPOILER BAR APPARATUS

[75] Inventor: Gregory L. Wedel, Beloit, Wis.

[73] Assignee: Beloit Corporation, Beloit, Wis.

[21] Appl. No.: 403,230

[22] Filed: Jul. 29, 1982

[51] Int. Cl.[3] ..... F26B 13/08

[52] U.S. Cl. ..... 34/110; 34/119; 34/124; 165/76; 165/89

[58] Field of Search ..... 34/108, 110, 119, 124, 34/125; 165/76, 89, 109; 335/295, 302, 306; 366/228; 432/118

[56] References Cited

U.S. PATENT DOCUMENTS

| | | | |
|---|---|---|---|
| 3,217,426 | 11/1965 | Barnscheidt et al. . | |
| 3,724,094 | 4/1973 | Appel et al. . | |
| 3,808,700 | 5/1974 | Kraus . | |
| 4,195,417 | 4/1980 | Mathews . | |
| 4,251,791 | 2/1981 | Yanagisawa et al. | 335/302 |
| 4,267,644 | 5/1981 | Schiel . | |
| 4,282,656 | 8/1981 | Schiel . | |
| 4,314,219 | 2/1982 | Haraguchi | 335/295 |

FOREIGN PATENT DOCUMENTS

| | | | |
|---|---|---|---|
| 932621 | 9/1955 | Fed. Rep. of Germany | 335/295 |

*Primary Examiner*—Larry I. Schwartz
*Assistant Examiner*—David W. Westphal
*Attorney, Agent, or Firm*—Dirk J. Veneman; Gerald A. Mathews; Raymond W. Campbell

[57] ABSTRACT

An improved spoiler bar, for rotatable, steam heated cylindrical dryers, which comprises an assembly of magnets, non-magnetic flux conducting backing and base plates, and magnetic flux conducting rails constructed to position the magnets in spaced adjacency to the dryer drum whereby the installation of the assemblies is facilitated and their strength of adherence to the inner surface of the dryer drum is optimized.

18 Claims, 13 Drawing Figures

MAGNETIC SPOILER BAR APPARATUS

BACKGROUND OF THE INVENTION

In the papermaking drying process, it has always been important to maximize heat transfer through the dryer drum to the paper web. In recent years, this heat transfer has been enhanced by mounting a plurality of longitudinal bars circumferentially around the inner surface of the steam heated dryer drums to interrupt the condensate which otherwise tends to rim around the inner surface in a substantially uniformly thick layer which effectivelly retards heat transfer from the steam to the paper web on the dryer's outer surface. When the condensate layer is interrupted, turbulence is generated in the layer which imporves the heat transfer through the condensate layer.

Such interruption of condensate flow around the inner dryer surface is referred to as "spoiling " in the papermaking industry, and the bars mounted within the dryer to accomplish this are called spooiler bars.

Barnscheidt et al and Kraus U.S. Pat. Nos. 3,217,426 and 3,808,700, respectively, teach the use and advantages of spoiler bars and the manner in which they can be mounted within a dryer drum utilizing outwardly biased rings and screws.

Appel et al further advanced the art by teaching a unique manner of circumferentially spacing the bars to optimize the turbulence of the condensate to enhance heat transfer.

More recently, the concepts of attaching spoiler bars magnetically (U.S. Pat. No. 4,195,417); with pins disposed in smooth holes, sometimes with magnetic assistance, (U.S. Pat. No. 4,267,644); and by a combination of pins disposed in smooth holes and springs biasing the bars against the dryer wall (U.S. Pat. No. 4,282,656) have been disclosed.

SUMMARY OF THE INVENTION

In this invention, the spoiler bars are assemblies comprising non-magnetic flux conducting base and backing plates and magnetic flux conducting rails which enclose one or more magnets. The magnets themselves are relatively small and, in the preferred embodiments, a plurality of them are grouped together in columns extending longitudinally in the spoiler bar assembly.

Since a dryer roll drum, or shell, is a steam heated pressure vessel, it is important for safety reasons that its structural integrity be maintained. As shown in some of the patents mentioned above, early methods of mounting spoiler bars utilized holes formed in the dryer drum to position and secure the spoiler bars. However, holes inherently decrease the strength of the drum which means either the drum has a smaller safety factor, or the drum wall must be thicker to compensate for the holes. Thicker drum walls retard the heat transfer process.

When spoiler bars are held in place magnetically, there are no holes needed in the drum wall, and, therefore, its strength is not compromised. However, it is also very important to maintain the spoiler bars in their carefully determined, circumferentially spaced positions to realize their advantages in improving heat transfer by breaking up the condensate layer. When the spoiler bars consist solely of metal magnets, such as Alnico V, for example, they have a tendency to shift their position during operation due to the inability of a "U" shaped magnet to develop and maintain sufficient magnetic force against the drum wall over an extended period of time at the steam temperatures (i.e. about 250° F.–400° F.) typically found in dryer drums, or a combination of these factors. Further, a bar shaped magnet has significantly less adherent force than a "U" shaped magnet.

By making the magnetic assemblies in the form of rectangular prisms, the flux density can be maximized by proper selection of the cross-sectional area and aspect ratio of the magnetic material and proper selection of the material and thickness of the magnetic flux conducting side rails. For convenience of manufacture and assembly, the magnets preferably comprise a plurality of magnetic segments within each spoiler bar assembly. Thus, the pole faces of the individual segments are arrayed contiguously to the rails of the assembly which thereby efficiently converts the rails into magnetic poles. The rails preferably have smaller, or equal sized, areas contacting the inner surface of the dryer drum which optimizes the adherent unit force of the rails against the dryer drum, as long as the rails are not saturated with magnetic flux, to provide superior mounting of the spoiler bar assemblies. Such improved adherence is of great importance since the controlled interruption of the condensate is a function of the precise spacing of the spoiler bars around the inner circumference of the dryer drum which must be maintained to achieve optimum heat transfer. Further, if the spoiler bars shift their position, the dryer may become unbalanced which would result in serious operational problems and inefficiencies.

In using non-magnetic flux conducting backing and base plates, and magnetic flux conducting rails, there is a minimum of flux loss and maximum flux is channeled from the magnet to the dryer drum for improved adherence. Ceramic magnets are preferred because of their high normal and intrinsic coercive force values and the stability of their magnetic strength at the elevated temperatures of the dryer drums. Surrounding the ceramic magnet with backing plates, base plates and rails increases the structural strength of the spoiler bars and protects the ceramic magnet from being damaged by being mishandled during installation and by loose scale in the dryer drum during operation.

Accordingly, it is an object of this invention to provide an improved magnetic spoiler bar capable of maintaining its position within a steam heated dryer drum in operation indefinitely without shifting position.

Another object of this invention is to provide a spoiler bar assembly which is comprised of magnetic flux conducting rails, and non-magnetic flux conducting backing and base plates which together form a rigid, deformation resistant structure holding a magnet whereby the magnetic flux is directed through the rails into the dryer drum on which the assembly is mounted.

Still another object of this invention is to provide a magnetic spoiler bar assembly wherein the magnet is in the shape of a rectangular prism, and the magnetic flux paths are short and efficiently channeled into the dryer drum.

A feature and advantage of this invention is the provision of a spoiler bar assembly having high structural strength and which utilizes a ceramic magnet.

These and other objects, features and advantages of this invention will become more readily apparent to those skilled in the art upon reading the following description of the preferred embodiments in conjunction with the attached drawings.

DESCRIPTION OF THE PREFERRED EMBODIMENTS

Figure 1:
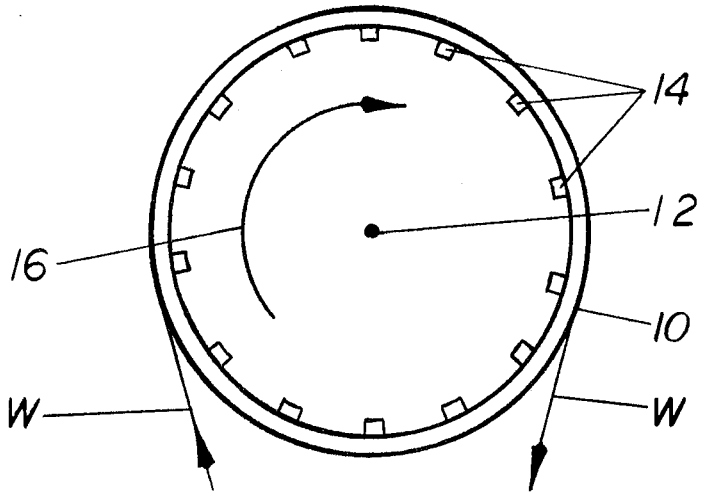
FIG. 1 is an end view of a dryer drum with its head removed exposing the axially extending, circumferentially arrayed spoiler bar assemblies.

As shown in FIG. 1, a plurality of longitudinally extending, parallel spoiler bars 14 are disposed circumferentially about the inner surface of dryer drum 10 which rotates about its longitudinal axis 12 in the direction of arrow 16. In modern papermaking machines, the paper web traveling through the dryer section can easily attain speeds of 3,000 fpm, and higher. This corresponds to a rotational speed on a 6 ft. diameter drum of about 160 rpm. At these speeds, any weakness in the means attaching or securing the spoiler bars to the inner surface of the dryer drum can permit the spoiler bars to shift their positions and move to the detriment of the operation and efficiency of the dryer drum. In addition, the moving layer of liquid condensate from the condensing steam within the dryer drum will exacerbate any impairment of the spoiler bar mounting system and their tendency to move, thus accelerating the onset of a potentially destructive situation.

In the following descriptions of the various configurations of the assemblies, and magnetic segments which are mounted in the assemblies, corresponding parts in each embodiment will be numbered with the two digit numerals used in FIGS. 1 and 2, but prefaced by a different hundred series. Thus, the backing plate 20 in FIG. 2 is designated as backing plate 120 in FIG. 4, and so forth.

Figure 2:
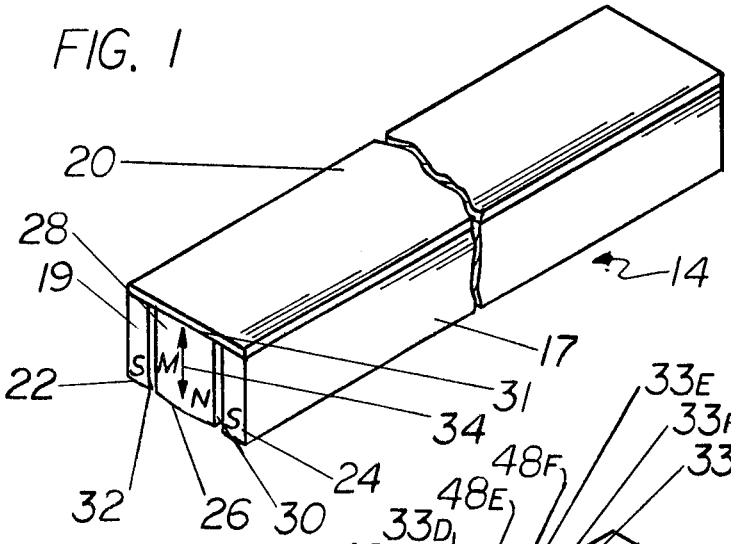
FIG. 2 shows a spoiler bar assembly wherein the magnet orientation is vertically arrayed.

In FIG. 2, a spoiler bar assembly 14 has a pair of horizontally spaced, parallel side rails 17, 19 which extend downwardly from an upper backing plate 20. A magnet 28 is disposed within the rail and backing plate structural assembly with axially extending spaces 30, 32 between it and the respective side rails. The magnet is disposed with its north/south poles (N/S) vertical so the magnetic flux field M, shown by the double headed arrow 34, also travels vertically through the magnet. The lower end surfaces 22, 24 of the side rails and the lower pole face (extending from edge 26) of the magnet are curved slightly to conform to the radius of curvature of the dryer drum on which the spoiler bars are mounted. This is shown exaggerated in FIG. 2 (and FIGS. 3, 4, 6, 8, 10 and 12) for purposes of illustration.

When mounted in the dryer drum, the upper surface of the magnet is in direct contact with the lower surface of backing plate 20, as shown at 31. In the embodiment shown in FIG. 2, side rails 17, 19 and backing plate 20 are all constructed of a magnetic flux field conducting material, such as mild steel. The side rails and backing plate are preferably formed from a single piece of metal, or attached to one another, such as by welding. The magnetic flux field flows from the magnet into the backing plate and through the side rails into the iron dryer drum. With the lower face of the magnet forming the north pole N, the magnetic flux field flows vertically up through the top plate and down the side rails to make the lower faces 22, 24 of the rails the south pole S. Thus, the magnet is held in place by the magnetic flux field conducting backing plate 20 and side rails 17, 19 which are not themselves magnets.

Since the preferred material for the magnet is a ceramic, which can be chipped or cracked relatively easily, the metal side rails and backing plate further function as a structural enclosure to protect the magnet from damage.

Figure 3:
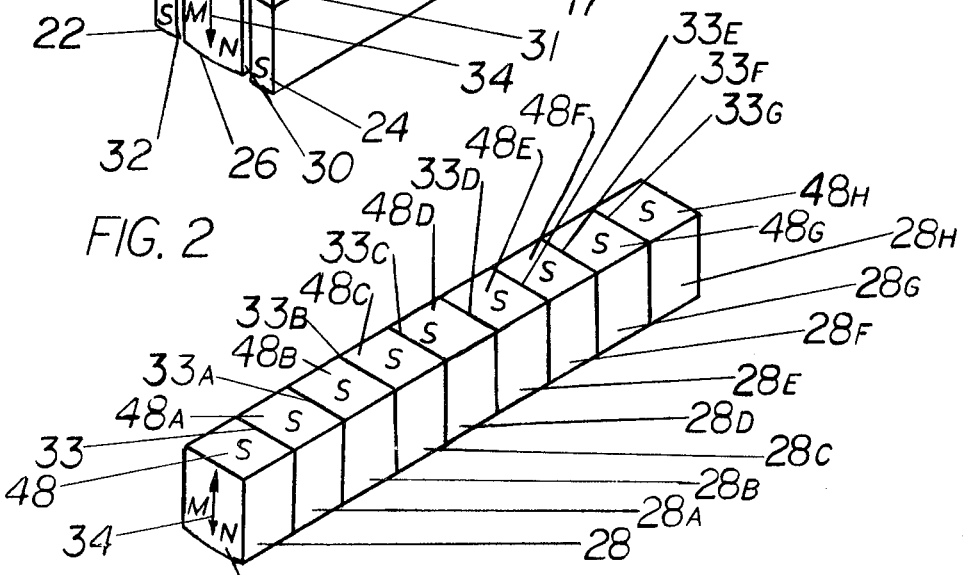
FIG. 3 illustrates the magnet in the assembly shown in FIG. 2 as comprising a plurality of aligned magnetic segments.

In FIG. 3, the magnet is shown as comprising a plurality of magnetic segments 28, 28*a*, *b*, *c*, *d*, *e*, *f*, *g* and *h*. These segments are axially aligned and arrayed so their poles N, S, are disposed on their lower and upper faces, respectively. The individual magnetic segments are aligned with their top edges 33, 33*a*, *b*, *c*, *d*, *e*, *f* and *g* in a horizontal plane along their top surfaces.

Since the lower faces of the segments cannot be seen in the figure, the N is shown on the bottom of the front side of segment 28 with the understanding that the north pole N is on the diametrically opposed (i.e. bottom) face from the top face 48 on which the south pole S is located. By providing the magnet in the form of a plurality of magnetic segments, the spoiler bar assemblies 14 can be made in convenient lengths, such as about 3 ft., and mounted longitudinally within the dryer drum in end abutting arrangement to extend for substantially the entire length of the dryer drum such as, for example, about 24 ft. Typically, spoiler bars are about 0.5 inch to about 1.5 inches high, and about 1.0 inch wide. This both facilitates the manufacture and installation of the spoiler bars as well as permitting the individual 3 ft. assembly sections to have a slight gap between them to allow for expansion of the backing plate and side rails as they become heated during operation.

Figure 4:
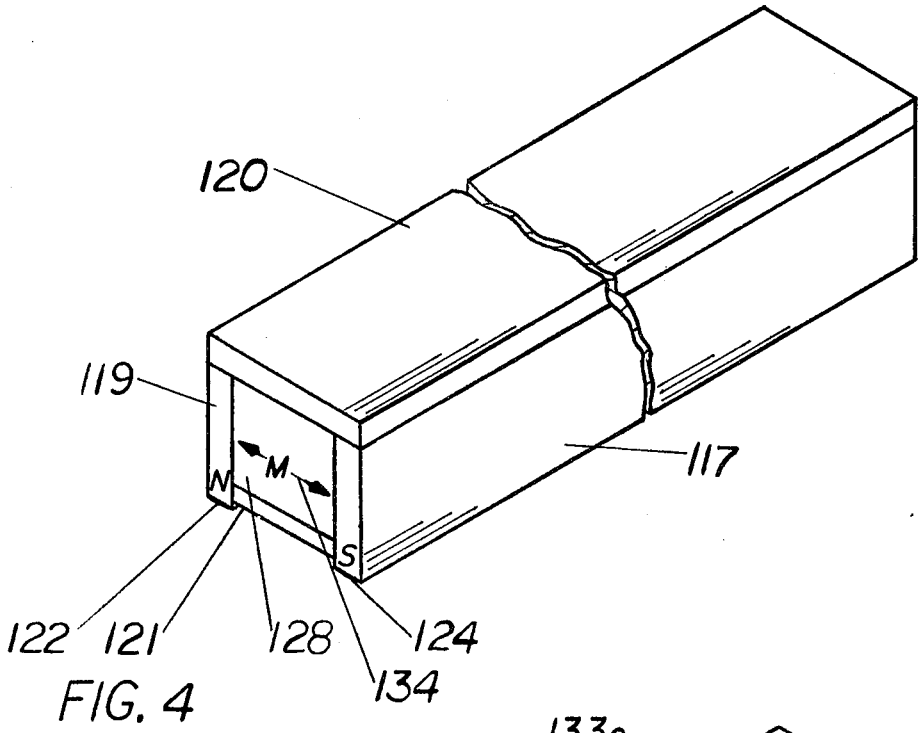
FIG. 4 shows a spoiler bar assembly wherein the magnet is horizontally arrayed.

FIG. 4 illustrates another embodiment of a spoiler bar assembly wherein a horizontally arrayed (i.e. the magnetic flux field M is horizontal) magnet 128 is positioned within a box-like structural assembly comprising a top backing plate 120, a lower base plate 121 which is spaced above the inner surface of the dryer drum and extends parallel to the backing plate in the longitudinal direction of the spoiler bar, and a pair of vertical, parallel, longitudinally extending side rails 117, 119. As shown by arrow 134, the magnetic flux field M of the magnet is horizontal with the north and south poles abutting the left and right side rails 119, 117, respectively. The backing and base plates 120, 121 are non-magnetic stainless steel, and the side rails 117, 119 are mild steel. Since the stainless steel plates do not conduct the magnetic flux field, all of the flux is conducted through the side rails into the dryer drum so the lower edge surfaces 122, 124 of the side rails form the north and south poles, respectively.

Since the cross sectional area of the side rails, taken in a horizontal plane extending longitudinally of the side rails, is preferably less than the cross sectional area of the rectangular prism shaped magnet taken through a vertical plane extending longitudinally of the magnet, the flux fields in the side rails are concentrated so the magnetic unit force by which the spoiler bar assembly adheres to the dryer drum is increased, or at least not decreased, thereby optimizing the strength of the magnet. In other words, within practical limits (i.e. not making the rail edge surfaces extremely narrow) if the cross sectional area of the side rails is less than, or equal to, the cross sectional area of the magnet, or magnetic segment, the unit magnetic force of attraction of the rail edge surfaces against the dryer drum is correspondingly greater than, or equal to, the unit strength of the magnet.

Figure 5:
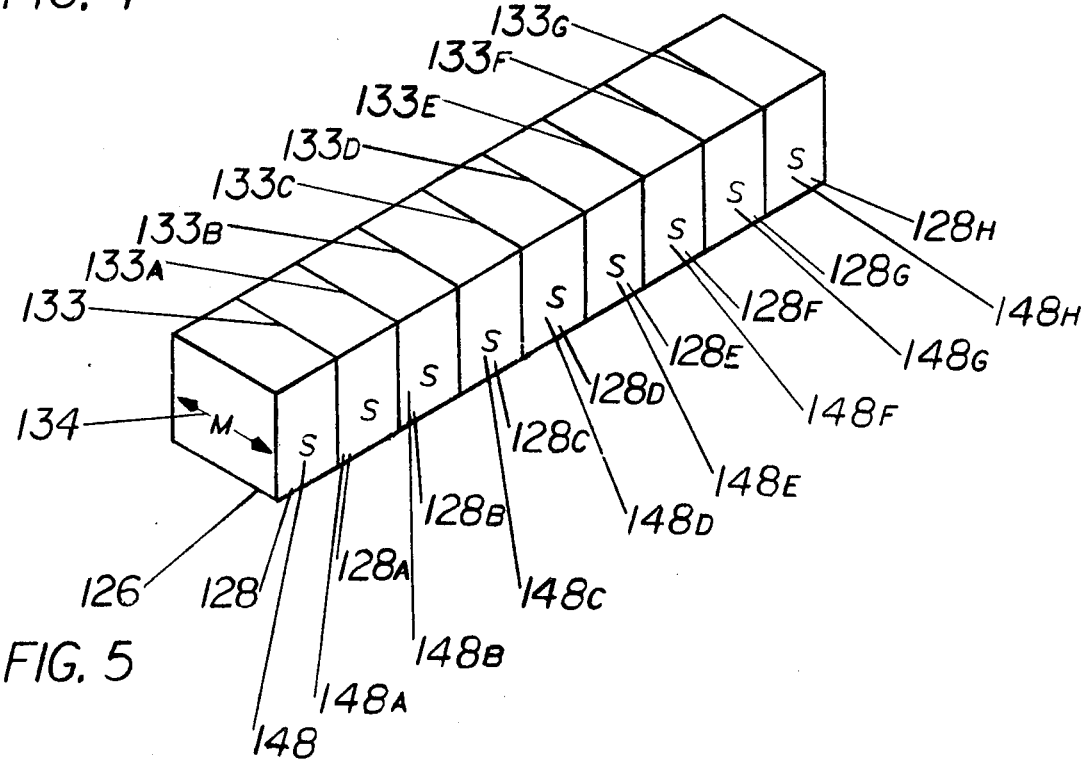
FIG. 5 shows how the magnet in the spoiler bar in FIG. 4 can comprise a plurality of aligned magnetic segments.

FIG. 5 illustrates how the magnet 128 can comprise a plurality of similar magnetic segments 128, 128*a, b, c, d, e, f, g, h* aligned axially with their north and south pole faces aligned vertically on either side. The lower edge 126 is straight because the lower surface of the magnet(s) is flat against the stainless steel base plate 121 which is spaced above the dryer drum surface to retard fringing of the magnetic flux lines so they will be directed through the side rails into the dryer drum.

Figure 6:
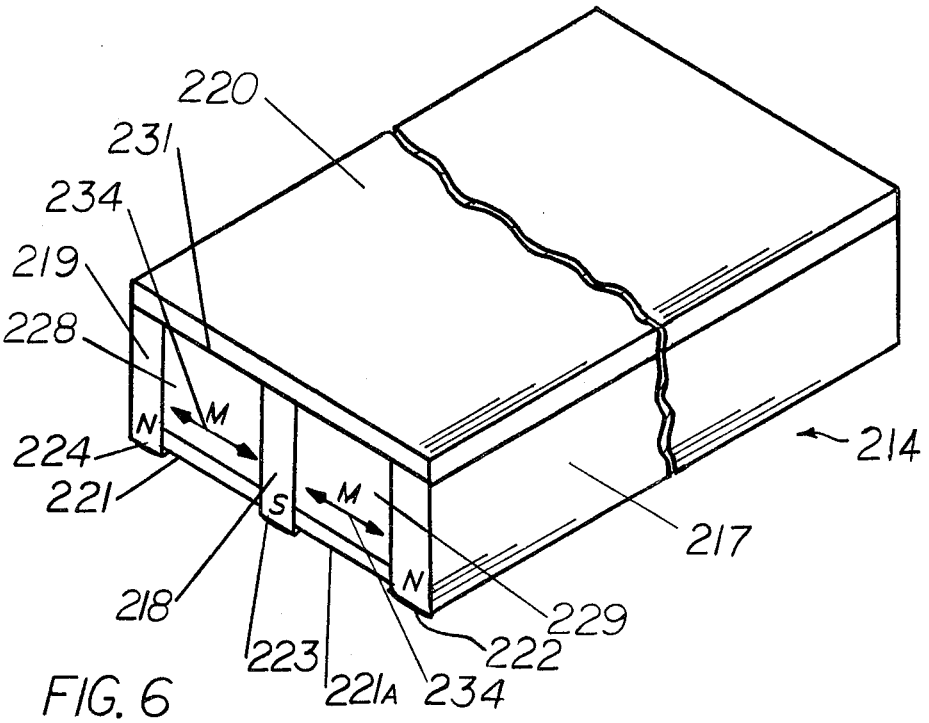
FIG. 6 shows a spoiler bar assembly similar to that shown in FIG. 4, but which incorporates a pair of horizontally arrayed magnets.

In FIG. 6, a spoiler bar assembly similar to the spoiler bar in FIG. 4 is shgwn, but wherein a pair of horizontally arrayed magnets 228, 229 are mounted between a pair of side rails 217, 219 with an intermediate side rail 218 between the magnets. In this arrangement, the magnets are arrayed with their flux fields M horizontally disposed as shown by the arrows and the vertical south pole faces of each magnet are facing inwardly toward one another and abutting the intermediate rail 218. The vertically disposed north pole faces are facing outwardly away from one another with each pole face abutting a corresponding side rail 217, 219. The backing plate 220 and base plates 221, 221*a* are non-magnetic stainless steel and the side and intermediate rails 217, 218, 219 are mild steel, so the lower edge surfaces of the side rails 217, 219 form the north poles while the edge surface 223 of intermediate rail 218 forms the south pole. This arrangement both increases the area of the rail edge surfaces contacting the dryer drum as well as increasing the strength of the magnetic field securing the spoiler bar assembly to the dryer drum.

Figure 7:
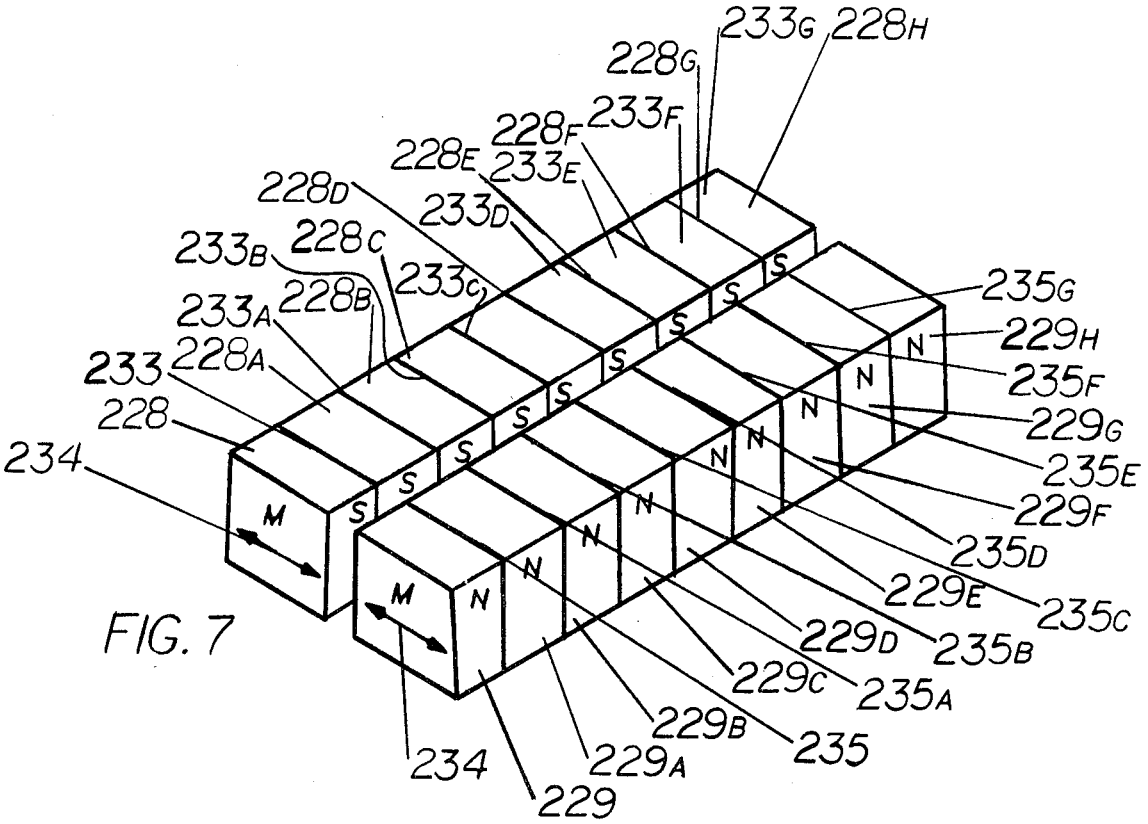
FIG. 7 shows how the magnets in the spoiler bar assembly in FIG. 6 can comprise two rows of aligned magnetic segments.

FIG. 7 is similar to FIGS. 3 and 5 in that it illustrates how the magnets 228, 229 can comprise a plurality of longitudinally arrayed magnetic segments 228, 228*a, b, c, d, e, f, g, h* and 229, 229*a, b, c, d, e, f, g, h*. It also more clearly shows the north and south pole faces in their array as the magnets are positioned in the assembly shown in FIG. 6.

Figure 8:
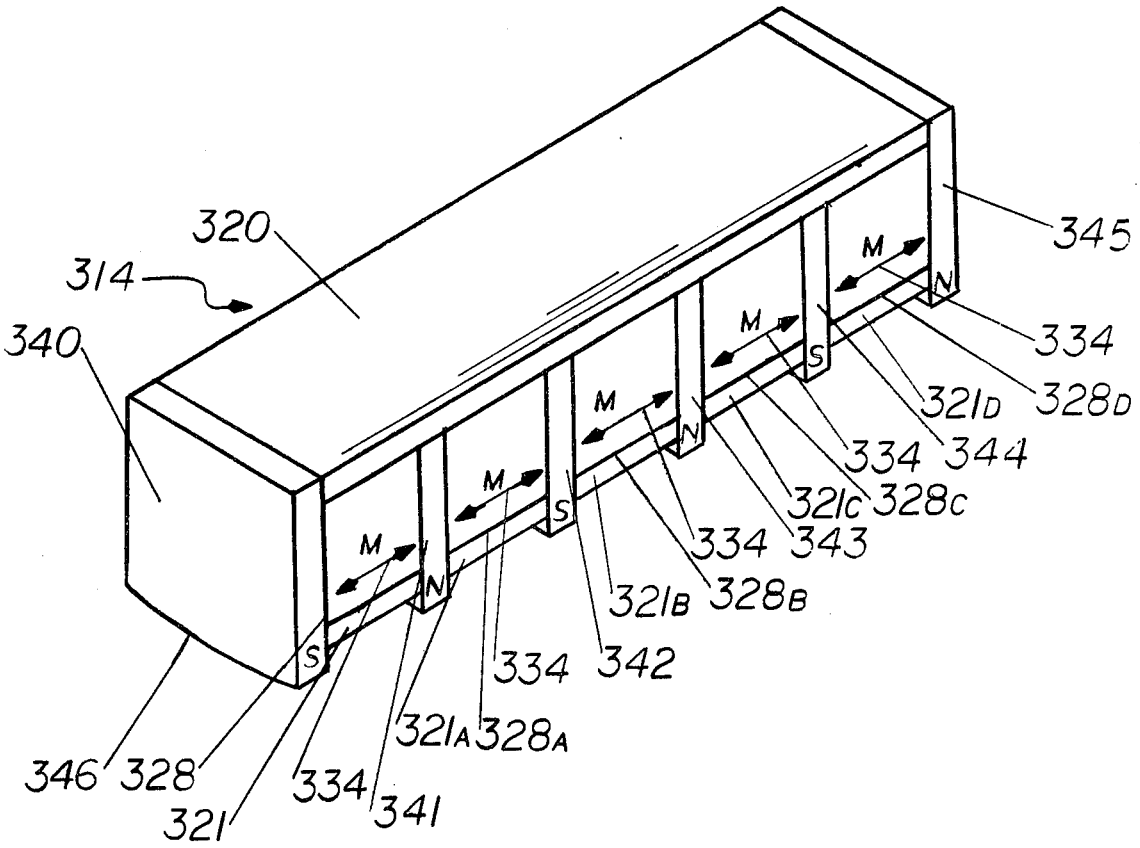
FIG. 8 shows a spoiler bar assembly wherein a plurality of rails are interposed between the magnetic segments which are axially aligned within the assembly.

FIG. 8 illustrates another embodiment of a spoiler bar assembly wherein a plurality of magnetic segments 328, 328*a*, 328*b*, 328*c*, 328*d* are positioned longitudinally along the length of the spoiler bar. Like the magnets in the spoiler bars shown in FIGS. 4, 6 and 10, the magnetic flux field M is parallel to the dryer drum surface. However, as shown by the two headed arrows 334, the magnetic flux fields of the individual segments are aligned, like the magnetic segments themselves, longitudinally along the length of the spoiler bar assembly. At the ends, and interposed between the magnet segments, are a plurality of side rails 340, 341, 342, 343, 344 and 345 which are all connected to the top backing plate 320, and each individual magnet segment has its corresponding base plate 321, 321*a*, 321*b*, 321*c* and 321*d* which are attached to the rails on either end of each plate. As in the embodiments as shown in FIGS. 4 and 6 (and FIGS. 10 and 12), backing plate 320 and base plates 321, 321*a*, 321*b*, 321*c*, 321*d*, are made of a non-magnetic field conducting material, such as stainless steel, while the rail members are made of a magnetic flux conducting material, such as mild steel. The stainless steel base plates are spaced above the dryer drum surface so that only the lower edge surfaces of the rails contact the dryer drum to prevent flux from short-circuiting through the base plates and not passing through the dryer drum. This maximizes the flux passing through the rails and dryer drum.

Figure 9:
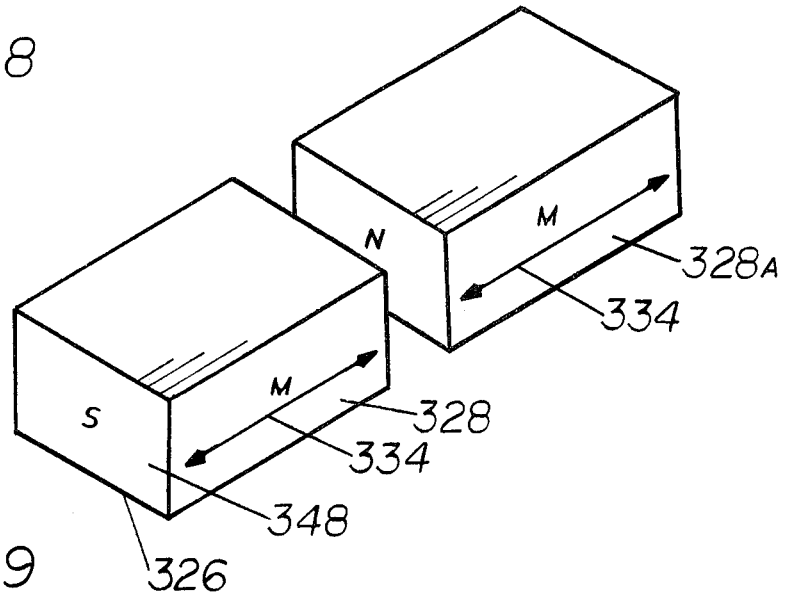
FIG. 9 shows a pair of adjacent magnetic segments in the spoiler bar assembly in FIG. 8.

If the magnetic segments are mounted within the spoiler bar assembly as shown in FIG. 9, with like magnetic poles abutting the rail between adjacent magnet segments, the magnetic poles alternate S, N, S, N, S, N along the longitudinal length of the spoiler bar assembly as shown in FIG. 8. The bottom edges of the rail members are rounded, such as shown at edge 346 on end rail 340 to enhance their area of contact against the dryer drum.

Figure 10:
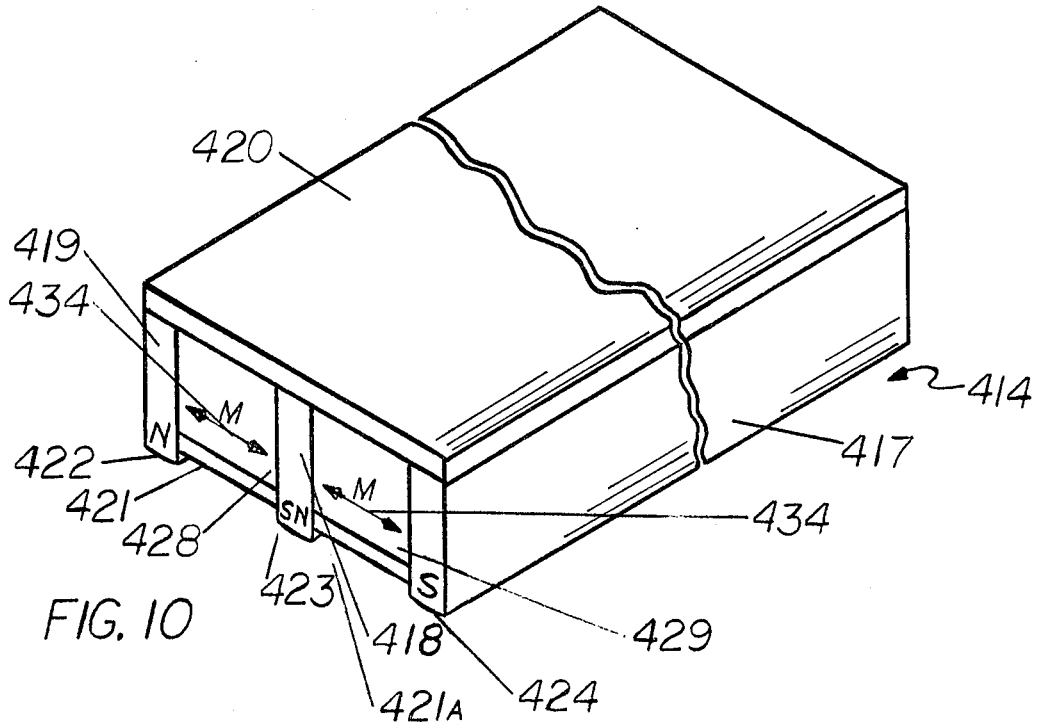
FIG. 10 shows a spoiler bar assembly similar to that shown in FIG. 6 except the poles of the magnet on the right side is reversed.
Figure 11:
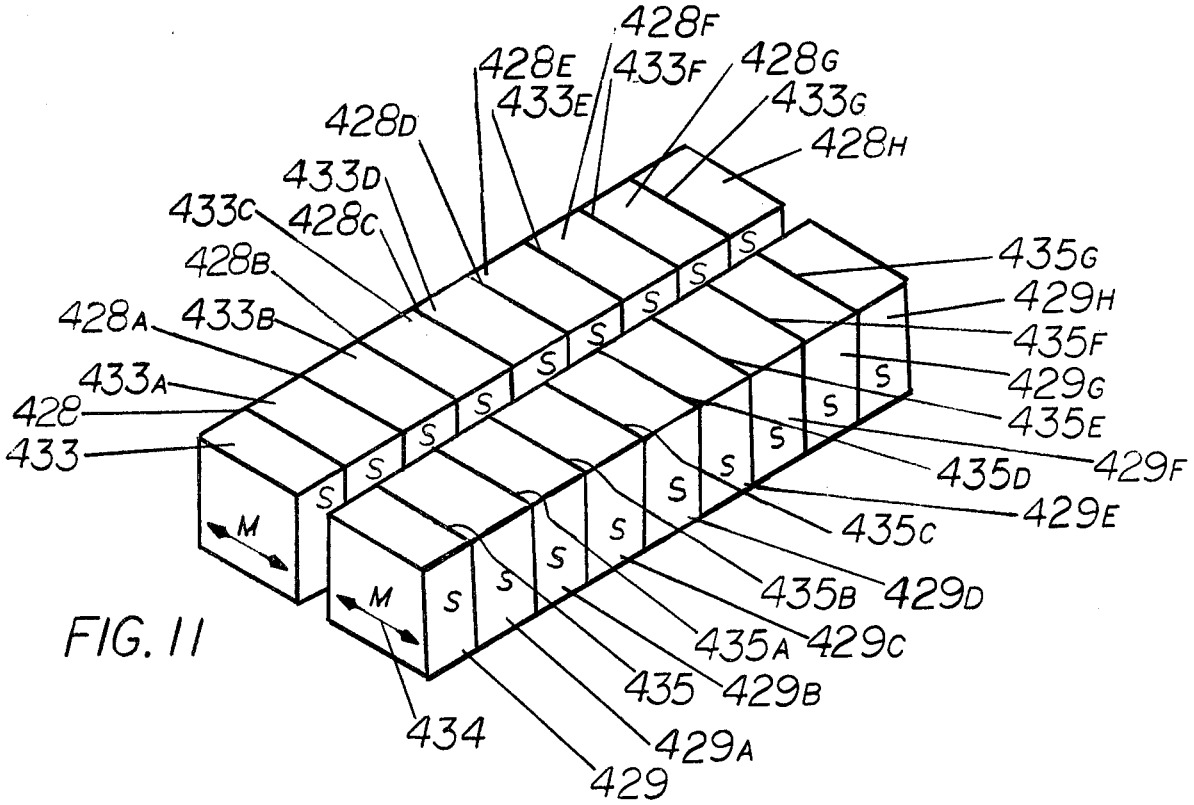
FIG. 11 shows a spoiler bar assembly similar to that shown in FIG. 7 except that the poles of the magnet, or column of magnetic segments, is reversed.

The spoiler bar assembly shown in FIG. 10, and the magnetic segments shown in FIG. 11, are similar to the assembly shown in FIG. 6 and arrayed magnetic segments shown in FIG. 7 with one major difference. Specifically, as more clearly shown in FIG. 11, the pole faces of the magnetic segments are arrayed in the same direction so that the faces of the magnetic segments contiguous with intermediate rail 418 are of opposite poles. Thus, side rail 419 is contiguous with the north pole face of magnetic segment 428 and has a north pole at its lower edge surface 422, intermediate rail 418 is contiguous with the south pole face of magnetic segment 428 and with the north pole face of magnetic segment 429 and therefore has both a north and south pole at its edge surface 423 and the outer rail 417 is contiguous with the south pole face of magnetic segment 429 and therefore has a south pole at its lower edge surface 424. The edges 435, 435*a–f* of segments 429, 429*a–f* are aligned in a plane in the same manner as edges 433, 433*a–f*.

Figure 12:
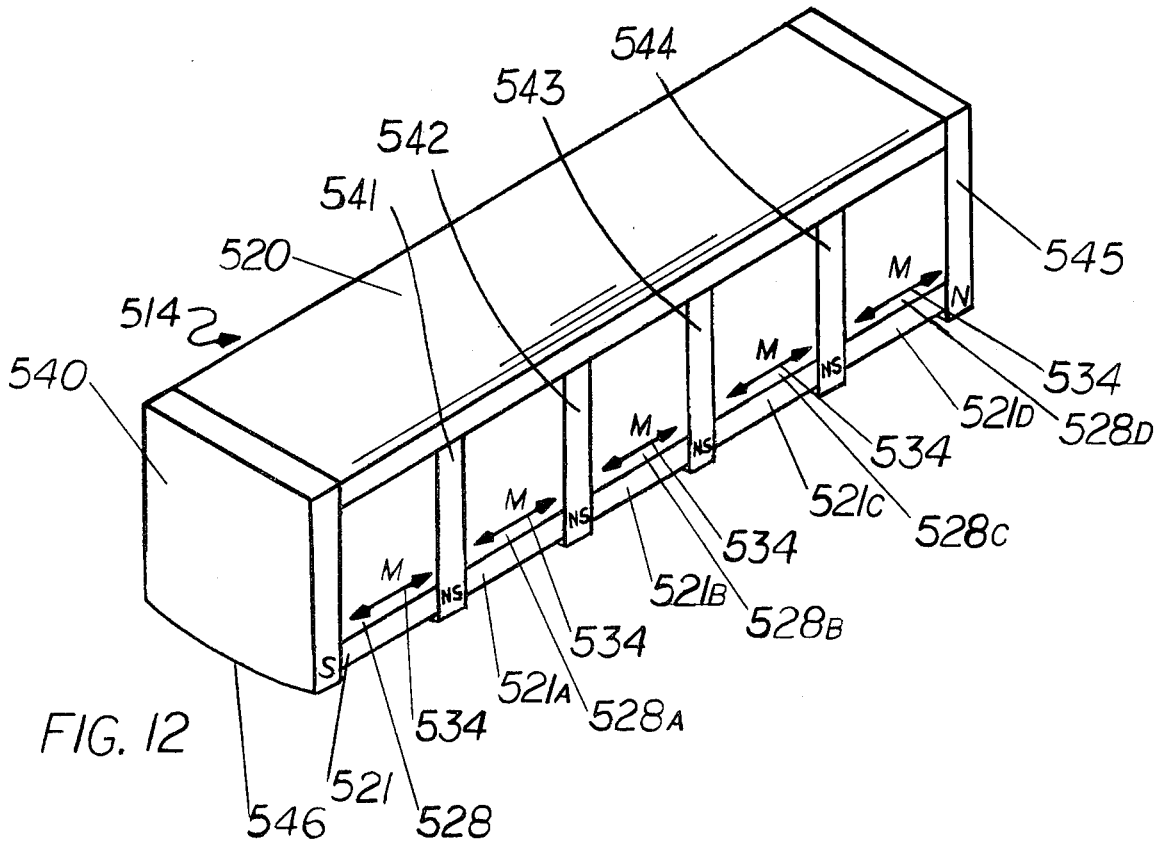
FIG. 12 shows a spoiler bar assembly similar to that shown in FIG. 8 except that the poles of the ends of adjacent magnets facing each other are alike.
Figure 13:
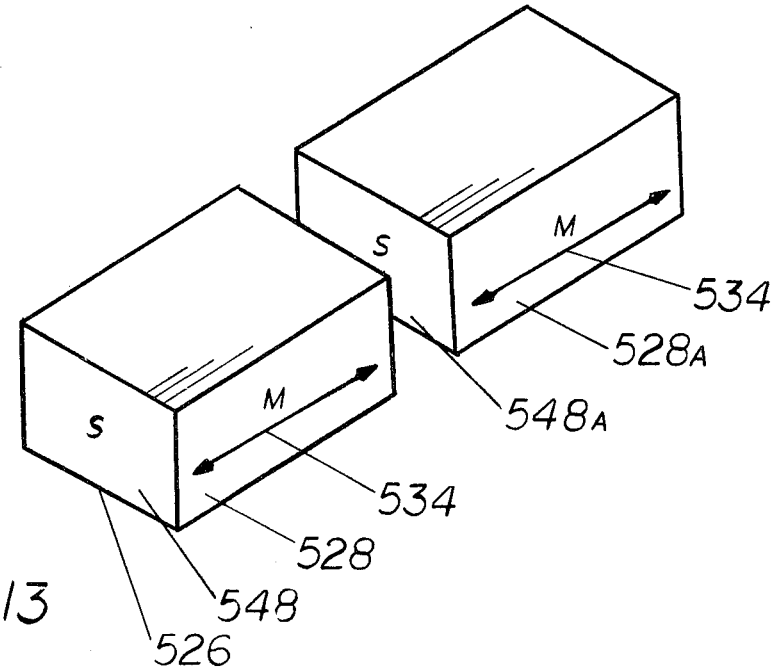
FIG. 13 shows two adjacent magnets, and their poles, in the spoiler bar assembly in FIG. 12.

In a manner analogous to the relationship between the assemblies in FIGS. 6 and 10, and FIGS. 7 and 11, the spoiler bar assembly in FIG. 12 is similar to that as shown in FIG. 8, and the magnetic segments shown in FIG. 13 are similar to those shown in FIG. 9 with the exception that the magnetic segments in the spoiler bar assembly in FIG. 12 are arrayed with the north and south magnetic poles in each magnetic segment pointing in the same direction. Thus for the two magnetic segments shown in FIG. 13, the faces 548, 548*a* of the south magnetic poles S of both segments are facing the viewer. This provides a spoiler bar assembly wherein the rail 340 on one end is magnetized with one pole, say south pole S, the intermediate rail members have both south and north poles, and the other end rail 345 has a north magnetic pole N.

Backing plate 520 and base plates 521, 521*a*, 521*b*, 521*c* and 521*d* are made of some non-magnetic flux conducting material, such as stainless steel, while rail members 540, 541, 542, 543, 544, 545 are of a magnetic flux conducting material, such as mild steel.

In all of the embodiments, the magnets, or magnetic segments, are secured in place by the backing plate, rails, base plate(s) and inside dryer drum surface, or a combination of these elements, depending on the embodiment, as previously described and shown in the figures. The backing plate, rails, and base plates are attached to one another, such as by welding, so the spoiler bar assemblies are quite rigid to maintain their shape during operation and to protect the magnets, which are preferably ceramic.

The backing plate, rails and base plates also hold the magnets, or magnetic segments, securely in place with the faces containing the poles, such as faces 48 containing the south magnetic pole, in plane contact with the rail members, which are always of a magnetic flux conducting material, such as mild steel. The backing plate and base plates are always of a non-magnetic flux conducting material, such as stainless steel, except for the embodiment shown in FIG. 2 wherein backing plate 20 comprises a magnetic flux conducting material. In all arrangements, the pole faces of the magnets, or magnetic segments, are always in snug contact with a magnetic flux conducting component (i.e. backing plate, side rails or the dryer drum). This relationship between these components provides for an optimum amount of magnetic flux to be directed through rail members and through the iron dryer drum to maximize the force of attraction and adherence between the spoiler bar assembly and the dryer drum. Further, since the cross sectional area of the rail members is the same, or less than, the cross sectional area of the magnets, or magnetic segments, the unit force of attraction of the rail edge faces against the dryer drum is as great, or greater in the case of smaller rail cross sectional area, as it would be if the magnet itself were directly in contact with the dryer drum. Of course, if the rails were substantially larger in cross sectional area than the cross sectional area of the magnets, the magnetic face could be dissipated and the magnetic forces of adherence decreased, but obviously this would not be done by those skilled in the art.

What is claimed is:

1. A spoiler bar assembly for mounting on the inner peripheral wall surface of a rotary, condensable fluid heated web drying drum, such as a steam heated dryer roll for drying a moist paper web on a papermaking machine, to interrupt the condensate on the inner wall surface to thereby improve the heat transfer through the drum, comprising:

at least a pair of rail members, which are not themselves magnets capable of conducting magnetic flux, and having edge surfaces for mounting against the inner peripheral surface of the dryer drum;

backing plate means attached to the rail members to form an enclosing structure therewith;

magnet means, having magnetic pole faces, disposed within the structure to form therewith a spoiler bar assembly, with at least one of its magnetic poles positioned to transmit magnetic flux through the rail members for securing the spoiler bar assembly to the dryer drum.

2. The spoiler assembly as set forth in claim 1, wherein:

the magnet means is disposed with its flux field arrayed vertically wherein its magnetic pole faces are facing toward and away from the drum surface;

the backing plate comprises a magnetic flux conducting material which bears against one of the magnetic pole surfaces of the magnet means and urges the opposite magnetic pole against the drum surface whereby the magnetic flux travels through the backing plate, rail members and drum wall.

3. The spoiler bar assembly as set forth in claim 1, wherein:

the backing plate member comprises a non-magnetic flux conducting material;

the magnet means is disposed with its flux field arrayed horizontally and its magnetic pole faces toward the contiguous rail members, whereby the magnetic flux travels through the rail members and drum wall.

4. The spoiler bar assembly as set forth in claim 3, wherein:

the magnet means comprises a pair of magnets extending longitudinally within the spoiler bar assembly, and further including;

a center rail member comprising magnetic flux conducting material, coextending with the pair of magnets, and between them, whereby the magnetic flux is directed through all three rail members into the drum to hold the spoiler bar assembly thereto.

5. The spoiler bar assembly as set forth in claim 4, wherein:

the magnet means are positioned with their like magnetic pole faces facing the center rail member whereby the edge surface of the center rail member contacting the drum surface is one magnetic pole and the edge surfaces of the outer rail members are the other magnetic pole.

6. The spoiler bar assembly as set forth in claim 4, wherein:

the magnet means are positioned with opposite pole faces facing the center rail member whereby the edge surface of the center rail member contacting the drum surface comprises both magnetic poles and the edge surfaces of the two outer rail members are of different magnetic poles.

7. The spoiler bar assembly as set forth in claims 3 or 4, wherein:

the magnet means is mounted within the rail members spaced above the drum wall surface whereby its magnetic flux is transmitted to the drum solely through the rail members.

8. The spoiler bar assembly as set forth in claim 7, further including:

a base plate means extending between the rail members and comprising a non-magnetic flux conducting material, said base plate means positioned between the magnet means and the drum surface to space the magnet means therefrom.

9. The spoiler bar assembly as set forth in claims 2 or 3 or 4, wherein:

the magnet means comprises a plurality of magnetic segments extending longitudinally within the spoiler bar assembly.

10. The spoiler bar assembly as set forth in claim 9, wherein:

all magnetic segments are arrayed with their like poles facing the same rail.

11. The spoiler bar assembly as set forth in claim 1, wherein:

each of the rail members is disposed within the spoiler bar assembly structure transversely to the longitudinal extension of the assembly;

the magnet means is disposed between adjacent rail members with its flux field arrayed horizontally and its pole faces toward the contiguous rail members whereby the adjacent rail edge surfaces comprise different magnetic poles and magnetic flux is directed through the rails and the drum wall.

12. The spoiler bar assembly as set forth in claim 11, wherein:

a plurality of rail members are disposed within the spoiler bar assembly transversely to its longitudinal extension;

the magnetic means comprises a plurality of magnetic segments with a segment mounted between each pair of adjacent rail members.

13. The spoiler bar assembly as set forth in claims 11 or 12, wherein:

the magnet means are spaced from the drum wall surface whereby its magnetic flux is transmitted to the drum solely through the rail members.

14. The spoiler bar assembly as set forth in claim 13, further including:

a base plate means extending between the rail members and comprising a non-magnetic flux conducting material, said base plate means positioned between the magnet means and the drum surface to space the magnet means therefrom.

15. The spoiler bar assembly as set forth in claim 12, wherein:

the magnetic segments are positioned with like pole faces on adjacent segments contacting both sides of the rail member between such adjacent magnetic segments whereby the edge surfaces of successive rail members extending down the longitudinal length of the spoiler bar assembly alternate between north and south.

16. The spoiler bar assembly as set forth in claim 12, wherein:

the magnetic segments are positioned with unlike magnetic pole faces on adjacent segments contacting either side of the rail member between such adjacent magnetic segments whereby the edge surfaces of successive rail members extending down the longitudinal length of the spoiler bar assembly each have both north and south poles.

17. The spoiler bar assembly as set forth in claim 11, wherein:

the base plate edge surfaces toward the drum are curved to conform with the drum surface curvature.

18. The spoiler bar assembly as set forth in claim 1, wherein:

both magnetic pole faces of the magnetic means are positioned relative to corresponding rail members to transmit magnetic flux therethrough to form a closed magnetic loop with the rail members and the wall of the drying drum.

* * * * *